US007393123B2

(12) United States Patent
Kasian et al.

(10) Patent No.: US 7,393,123 B2
(45) Date of Patent: Jul. 1, 2008

(54) DIFFUSER SHIELD AND LIGHTING SYSTEM FOR UNIFORM ILLUMINATION

(75) Inventors: John Stanley Kasian, Guelph (CA); Arie Vryenhoek, Cambridge (CA); Chau Qui Do, Guelph (CA); Radu Eugen Gafitanu, Burlington (CA); Martin Ferdinand Stocker, Guelph (CA); Sergei Paul Holoduke, Toronto (CA)

(73) Assignee: Metalumen Manufacturing Inc., Guelph Ontario (CA)

( * ) Notice: Subject to any disclaimer, the term of this patent is extended or adjusted under 35 U.S.C. 154(b) by 188 days.

(21) Appl. No.: 10/964,433

(22) Filed: Oct. 13, 2004

(65) Prior Publication Data

US 2006/0077665 A1 Apr. 13, 2006

(51) Int. Cl.
*F21V 11/14* (2006.01)

(52) U.S. Cl. ..... 362/311; 362/351; 362/355; 362/361; 362/97; 359/599; 40/579

(58) Field of Classification Search ..... 362/290, 362/291, 294, 311, 355, 361, 449, 455, 456, 362/351, 97; 359/599; 40/205, 572, 579, 40/580

See application file for complete search history.

(56) References Cited

U.S. PATENT DOCUMENTS

| | | | | | |
|---|---|---|---|---|---|
| 130,899 | A * | 8/1872 | Combs | 362/361 |
| 901,921 | A * | 10/1908 | Markman | 40/205 |
| 1,087,574 | A * | 2/1914 | Dawes | 40/572 |
| 1,095,321 | A * | 5/1914 | Fisk | 362/396 |
| 1,103,873 | A * | 7/1914 | Gentile | 40/205 |
| 1,237,148 | A * | 8/1917 | Aszman | 362/355 |
| 1,244,734 | A * | 10/1917 | Higgins | 362/355 |
| 1,534,222 | A * | 4/1925 | Lackstrom | 40/572 |
| 1,538,236 | A * | 5/1925 | Brandt | 40/572 |
| 1,578,721 | A * | 3/1926 | Lambert | 362/355 |
| 1,637,626 | A * | 8/1927 | Smith | 362/355 |
| 1,715,133 | A * | 5/1929 | Rebecca | 40/205 |
| 1,767,340 | A * | 6/1930 | Beman | 362/361 |
| 1,851,335 | A * | 3/1932 | Taliaferro | 362/363 |
| 4,335,421 | A * | 6/1982 | Modia et al. | 362/97 |
| 4,418,378 | A * | 11/1983 | Johnson | 362/97 |
| 6,053,625 | A * | 4/2000 | Bowker | 362/348 |
| 6,364,505 | B1 * | 4/2002 | Shoenfeld | 362/97 |
| 6,874,914 | B2 * | 4/2005 | Desanto et al. | 362/372 |
| 2003/0204976 | A1 * | 11/2003 | Doerr et al. | 40/553 |

* cited by examiner

*Primary Examiner*—Ismael Negron
(74) *Attorney, Agent, or Firm*—Senniger Powers LLP

(57) ABSTRACT

An apparatus for uniform illumination includes a light source and one diffuser shield maintained in proximity with the light source to uniformly disperse light from the light source. The diffuser shield is formed at least by an outer filter having a concave and perforated surface, and a translucent interior disk having two outer layers of transparent glass and an inner layer of white glass. The light source might be an induction lighting unit including a high frequency generator and might be associated with a supporting structure.

21 Claims, 8 Drawing Sheets

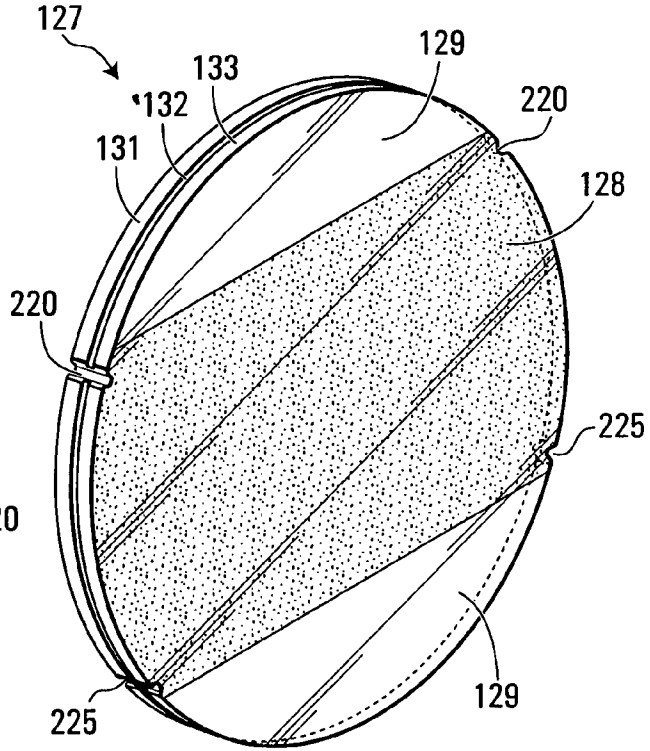
FIG. 5D
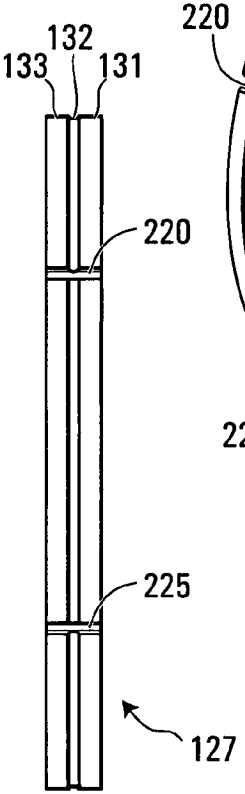
FIG. 5C
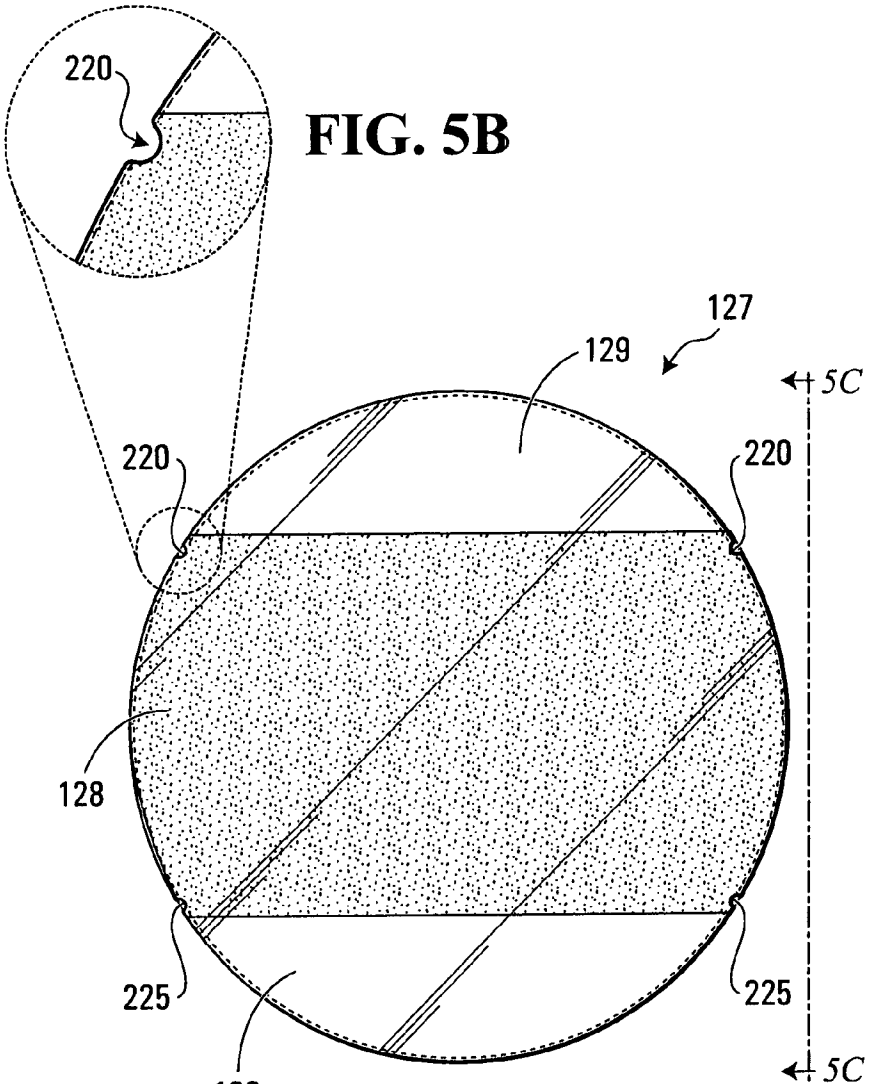
FIG. 5B
FIG. 5A

DIFFUSER SHIELD AND LIGHTING SYSTEM FOR UNIFORM ILLUMINATION

FIELD OF THE INVENTION

The present invention relates to the field of lighting systems. More particularly, the present invention relates to the use of a diffuser shield in association with a lighting unit for uniform illumination of a surface.

BACKGROUND OF THE INVENTION

A surface that is uniformly illuminated, with few or no bright or dim regions throughout the area illuminated, is visually attractive. When large in size, such a surface is likely to create a lasting impression on a viewer, and can be effective as a marketing or branding tool. In addition, uniformly illuminated surfaces can be useful in other applications such as x-ray viewers, etc.

As such surfaces increase in size, a number of lighting units may be required for complete illumination thereof. In such situations, uniform illumination of the surface can be difficult to achieve. Bright and/or dim regions are often present on the surface, thus decreasing the visual attractiveness and overall intended effect.

A number of solutions to the problems associated with providing uniform illumination of a large surface have been proposed. For example, in the past, High Intensity Discharge (HID) lighting units have been placed along the top and bottom of large surfaces in order to project light onto the surface. However, such systems do not provide uniform lighting of the surface, resulting in brighter regions near the top and bottom and dimmer regions towards the centre of the surface.

In addition, various lighting units, including fluorescent lighting units and Light Emitting Diodes (LED), have been used in combination with translucent surfaces in order to uniformly illuminate the surface. However, these methods of illumination can be very expensive to employ.

Similar problems are encountered in attempting to provide uniform lighting in general indoor and outdoor lighting applications.

SUMMARY OF THE INVENTION

In accordance with one aspect of the present invention there is provided a diffuser shield for the dispersion of light from a light source comprising an outer filter and an interior disk, wherein the diffuser shield is maintained in proximity with the light source to enable the outer filter and the interior disk to disperse light from the light source.

In accordance with another aspect of the present invention there is provided an apparatus for uniform illumination comprising at least one light source, at least one diffuser shield for the dispersion of light from the light source, said at least one diffuser shield comprising an outer filter and an interior disk, wherein the at least one diffuser shield is maintained in proximity with the light source to enable the outer filter and the interior disk to disperse light from said light source.

In accordance with another aspect of the present invention, the diffuser shield and apparatus discussed above disperse light from the light source onto at least one surface for uniform illumination of the at least one surface.

In an aspect of the lighting system of the present invention, diffuser shields are used in association with a lighting unit to uniformly disperse light from a lamp of the lighting unit onto a lighting footprint region on a projection side of a translucent surface. The light is further dispersed by the surface, and the lighting footprint region is uniformly illuminated when viewed from an opposite viewing side of the surface. When a number of lighting systems of the present invention are appropriately placed in relation to each other and the surface, those systems can be used to provide uniform illumination of one or more surfaces, irrespective of their size or shape. When used in combination with an induction lighting unit, the present invention provides an inexpensive and long-lasting method for uniform illumination of the surface or surfaces.

BRIEF DESCRIPTION OF THE DRAWINGS

Having generally described the nature of the invention, preferred embodiments will now be described with reference to the accompanying drawings, in which:

FIG. 5A is a rear view of the interior disk of the front diffuser shield of FIG. 3A.

FIG. 5B is an enlarged view of a holding groove of the interior disk of FIG. 5A.

FIG. 5C is a side view of the interior disk of FIG. 5A taken along line 5C-5C.

FIG. 5D is a rear perspective view of the interior disk of FIG. 5A.

DESCRIPTION OF PREFERRED EMBODIMENTS

The particularly illustrated embodiments are described in this section with reference to the drawings.

As discussed above, FIG. 1 shows an embodiment of the present invention comprising one lighting system that incorporates front and rear diffuser shields. The lighting system depicted in FIG. 1 employs a typical induction lighting unit which is known in the art. An induction lighting unit provides an inexpensive, long-lasting means of illumination with good lamp efficiency. However, as discussed below, other types of lighting units could also be employed in the present invention.

Figure 1:
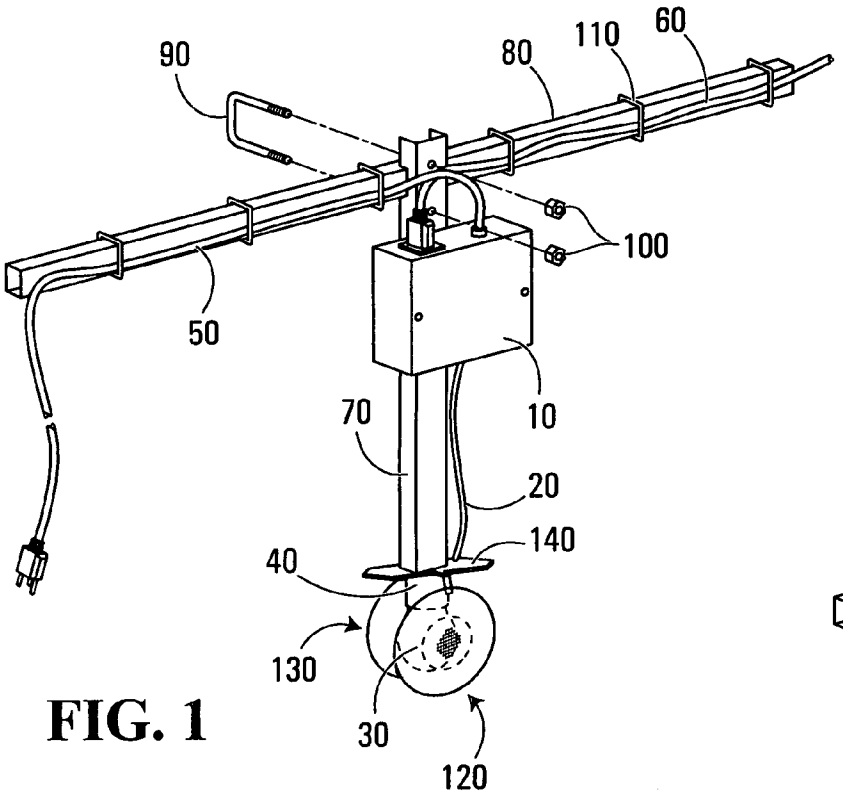
FIG. 1 is a partially exploded front perspective view of an embodiment of the present invention, which comprises one lighting system incorporating a front and rear diffuser shield, the lighting system being attached to a vertical support projecting downwardly from a horizontal support.

The induction lighting unit depicted in FIG. 1 comprises a high frequency (HF) generator 10 which is connected by way of a coaxial cable 20 to a lamp 30. The lamp 30 is maintained in a lamp holder 40.

The HF generator 10 of the induction lighting unit is connected by way of a power cord 50 to a power line (not shown). The power line can be a typical 120 V line from a typical power outlet. Where multiple induction lighting units are present, the HF generator 10 can also be connected in parallel by way of a connecting cord 60 to the HF generator of another induction lighting unit (not shown). Alternatively, the HF generator 10 may not be connected to any other HF generators; for example, where separate, unconnected lighting systems are used, where only one lighting system is used, or where the HF generator is the last in a line of connected generators.

The components of the induction lighting unit are associated with a vertical support 70. In the embodiment depicted in FIG. 1, the vertical support 70 extends downwardly from a horizontal support 80. Alternatively, the vertical support might extend upwardly, diagonally or otherwise from the horizontal support. In the embodiment depicted, the vertical support 70 and horizontal support 80 are connected by a U-bolt 90 and corresponding nuts 100. However, it should be noted that any suitable means of connection would be acceptable, including other nut and bolt systems, nails, screws, straps, fasteners or the like. Alternatively, the vertical and horizontal supports may comprise a single formed unit. The supports can be constructed of any suitable material, including metal, aluminum, wood, plastic or the like.

In the embodiment depicted, the HF generator 10 is secured to the vertical support 70 near the connection of the vertical support 70 to the horizontal support 80 by screws (not shown). However, it will be understood that the HF generator could be secured to any appropriate location on either the vertical or horizontal support. In addition, securement of the HF generator 10 could be by any suitable means, including by nuts and bolts, nails, straps, fasteners or the like. Both the power cord 50 and the connecting cord 60 can be secured to the horizontal support 80 by cable ties 110, or other suitable means, if required. The coaxial cable 20 of the induction lighting unit may also be secured to the vertical support 70 (not shown), if necessary, by any appropriate means.

Two diffuser shields 120, 130 are associated with a heat sink 140 which is associated with the free end of the vertical support 70. The heat sink 140 supports the diffuser shields 120, 130 and assists in the dissipation of heat from the lamp 30 to prevent overheating. The diffuser shields and heat sink will be described in further detail in relation to FIGS. 3A, 3B, 3C, 3D and 3E below.

Figure 2:
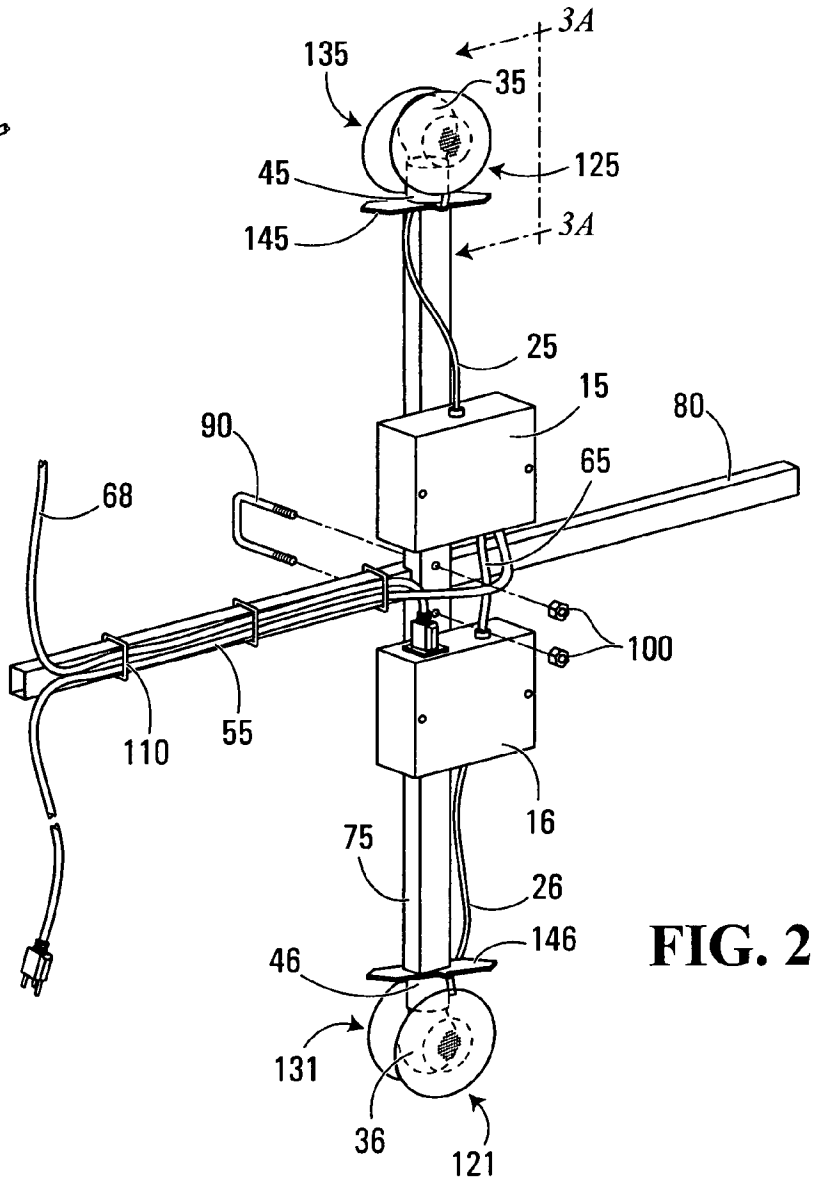
FIG. 2 is a partially exploded front perspective view of a second embodiment, comprising a first (upper) and second (lower) lighting system, each incorporating front and rear diffuser shields, the lighting systems being attached at opposite ends of a vertical support projecting both upwardly and downwardly from a horizontal support.

FIG. 2 depicts a second embodiment of the present invention, similar to the embodiment depicted in FIG. 1, except that the embodiment of FIG. 2 comprises a first (upper) and second (lower) lighting system. The two lighting systems are attached at opposite ends of a vertical support 75 that extends both upwardly and downwardly from the horizontal support 80. In the embodiment depicted, the vertical support 75 and horizontal support 80 are connected by a U-bolt 90 and corresponding nuts 100. However, again, it should be noted that the vertical support 75 and horizontal support 80 could be connected by any suitable means, or could be one formed piece.

The HF generator 15 of the first lighting system is connected to the HF generator 16 of the second lighting system by a connecting cord 65. In the embodiment depicted, the HF generator 15 of the first lighting system is connected by way of a power cord 55 to a power line (not shown). A second connecting cord 68 connects the HF generator 16 of the second lighting system to the HF generator of a third lighting system (not shown). Alternatively, there may be no further connection, as in the circumstances described above. The first and second HF generators 15, 16, lamps 35, 36, lamp holder 45, 46, heat sinks 145, 146 and diffuser shields 125, 135, 121, 131 are attached to the vertical support 75 in a similar manner as that described above in relation to FIG. 1. Similarly, the first and second coaxial cables 25, 26, the power cord 55 and connecting cords 65, 68 can be attached to the vertical support 75 or horizontal support 80 by cable ties 110, if desired, or by any acceptable means.

FIGS. 1 and 2 are intended to provide examples of how the lighting systems may be supported structurally in carrying out the invention. It should be noted that the present invention is not limited to the structural configurations set out in FIGS. 1 and 2. For example, a configuration may exist where three or four or more induction lighting units may be supported by the same structural components, which can be horizontally, vertically, diagonally directed, or otherwise. In addition, in all cases, the various components of the induction lighting units could be attached to the vertical support, horizontal support or both. Finally, it will be understood that the structural configurations depicted in FIGS. 1 and 2 can be connected to any number of other structural configurations in carrying out the invention, whether they be of similar structure or otherwise.

Figure 3A:
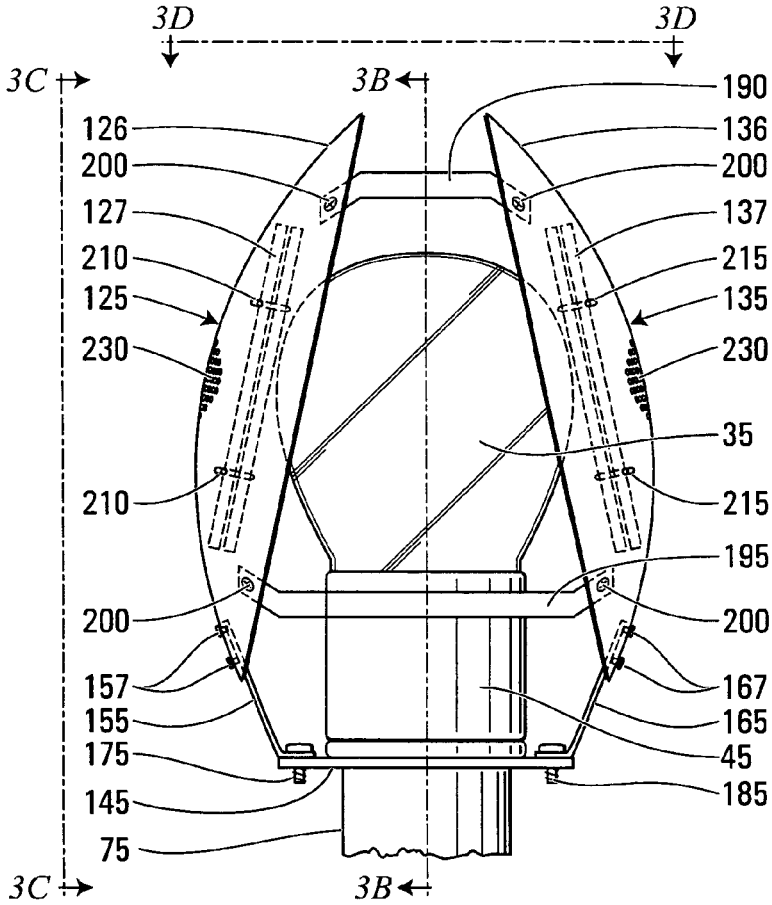
FIG. 3A is a side view of the lamp and front and rear diffuser shields of the first (upper) lighting system of FIG. 2 taken along line 3A-3A, each diffuser shield comprising an outer filter and an interior disk.

The lamps and front and rear diffuser shields depicted in FIGS. 1 and 2 will now be described in detail in relation to FIGS. 3A, 3B, 3C, 3D and 3E. FIG. 3A is a side view of the lamp 35 and diffuser shields 125, 135 of the first (upper) lighting system of FIG. 2, taken along line 3A-3A. It will be understood that the other lamps and diffuser shields depicted in FIGS. 1 and 2 are configured in a similar manner.

The lamp 35 of the induction lighting unit is maintained in a lamp holder 45 which is secured to the heat sink 145 by screws (not shown) or other suitable means. Alternatively, the lamp holder 45 may be integral with the heat sink 145. In turn, the heat sink 145 is secured to the vertical support 75, again by any suitable means (not shown). Alternatively, the heat sink 145 can be integral with the vertical support 75. The lamp 35 employed in the embodiment described is a 55 Watt lamp. However, it will be understood that lamps of other wattages could also be used. In addition, the lamps employed could be any suitable shape or size.

The diffuser shields 125, 135 each comprise perforated concave outer filters 126, 136 and substantially planar and translucent interior disks 127, 137. In the illustrated embodiment, the outer filters 126, 136 are substantially coaxial with their corresponding interior disks 127, 137. In FIGS. 3A, 3C, 3D and 3E, only a portion of the perforations 230 of the outer filters 126, 136 are shown. However, it will be understood that the entire surfaces of the outer filters 126, 136 of the illustrated embodiment contain perforations.

The diffuser shields 125, 135 are maintained on opposite sides of the lamp 35 so that the concave sides of the outer filters 126, 136 are directed towards the lamp 35, and so that the diffuser shields 125, 135 are substantially concentric when viewed from the front or rear. The outer filters 126, 136 of the diffuser shields 125, 135 are secured to one end of shield supports 155, 165, by screws 157, 167 through holes in the outer filters 158, 168 (see FIG. 3E). The opposite ends of the shield supports 155, 165 are secured to the heat sink 145 by screws 175, 185. It should be noted that the outer filters 126, 136 could be attached to the shield supports 155, 165, and the shield supports 155, 165 could be attached to the heat sink 145, by any suitable means, or indeed, any or all of these components could be integral. In addition, it should be noted that in other embodiments, the diffuser shields 125, 135 may be connected directly to the vertical support 75, with or without the presence of a heat sink 145, and that the diffuser shields 125, 135 could also be integral with the vertical support 75.

Pairs of upper supports 190 and lower supports 195 are associated with the diffuser shields 125, 135 to maintain appropriate distance between the diffuser shields 125, 135 and for added support. In the present embodiment, the upper supports 190 and lower supports 195 are secured by screws 200 in holes 205 (see FIG. 3E) in the outer filters 126, 136 of the diffuser shields 125, 135. It will be understood that in other embodiments, greater or fewer supports may be present, or indeed no supports may be present at all. Additionally, it will be understood that the attachment of the supports, if present, to the diffuser shields may be by any suitable means, and understood that the supports might also be integral with the diffuser shields.

The securement of the interior disk 127 to the outer filter 126 of the front diffuser shield 125 will now be described. It will be understood that the interior disk 137 and the outer filter 136 of the rear diffuser shield 135 are secured in a similar manner. The interior disk 127 is secured to the outer filter 126 by a pair of wire braces 210. The wire braces 210 run substantially parallel along upper and lower portions of the rear face of the interior disks 127. This can best be seen in FIG. 3C and in relation to the wire braces 215 of the rear diffuser shield 135 in FIG. 3E. The ends of the wire braces 210 pass through appropriately located perforations in the outer filter 126. Once sufficient pressure is exerted by the wire braces 210 on the rear face of the interior disk 127 to secure the interior disk 127 to the outer filter 126, the ends of the wire braces 210 are bent on the front side of the outer filter 126 to maintain this pressure. As will be discussed in relation to FIGS. 5A, 5B, 5C and 5D below, the wire braces 210 engage upper and lower holding grooves 220, 225 on opposite sides of the interior disk 127, to further prevent the possibility of slippage of the interior disk 127 in relation to the outer filter 126. In any event, it will be understood that any suitable means for securing the interior disk 127 to the outer filter 126 would also be possible. In addition, it will be understood that it is possible that the interior disk 127 could be integral with the outer filter 126 in some embodiments of the present invention.

Figure 3B:
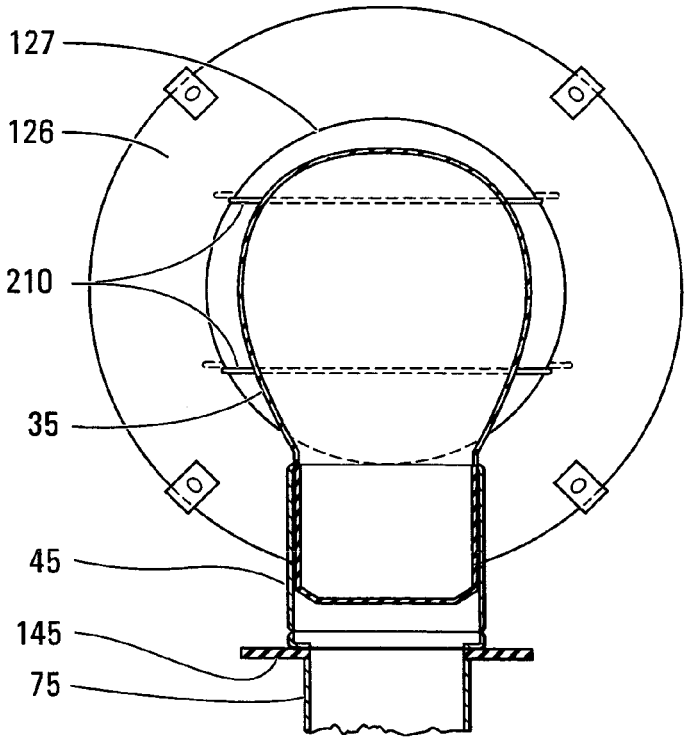
FIG. 3B is a rear cross-sectional view of the lamp and front diffuser shield of FIG. 3A taken along line 3B-3B.
Figure 3C:
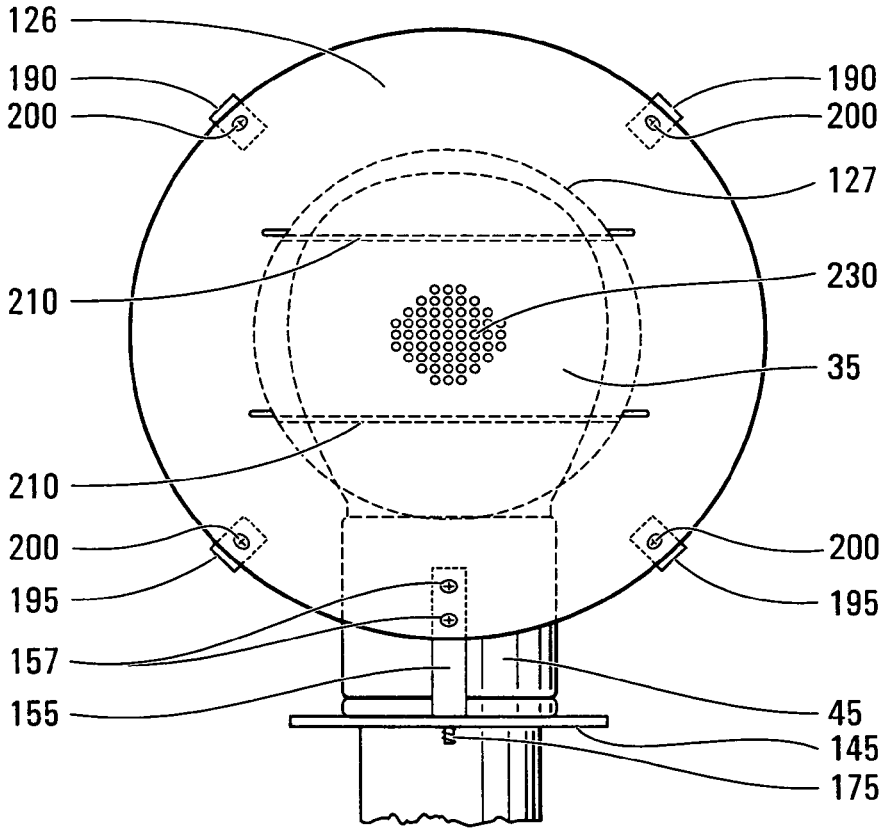
FIG. 3C is a front view of the lamp and front diffuser shield of FIG. 3A taken along line 3C-3C.
Figure 3D:
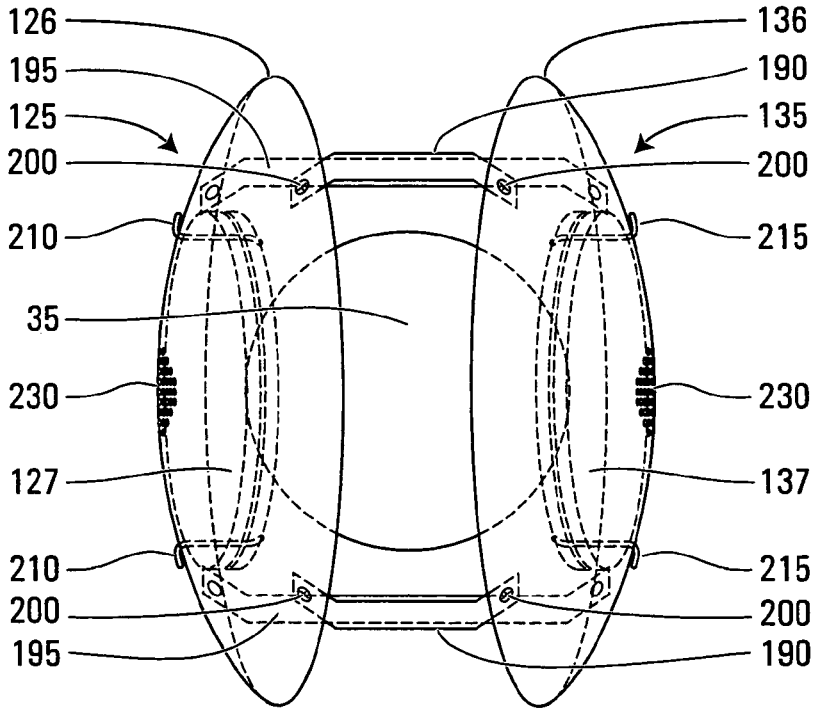
FIG. 3D is a top view of the lamp and diffuser shields of FIG. 3A taken along line 3D-3D.
Figure 3E:
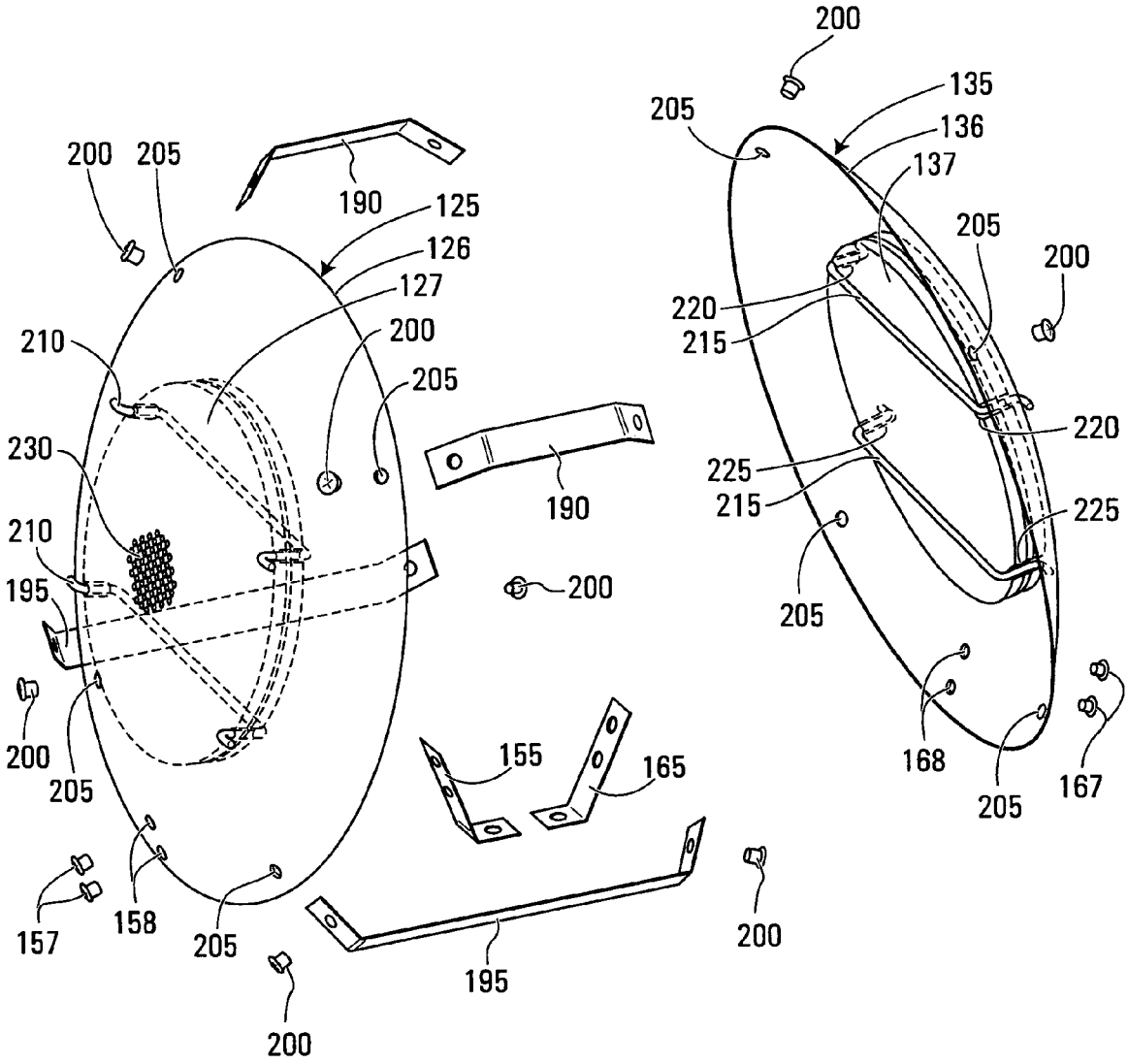
FIG. 3E is a side exploded perspective view of the diffuser shields of FIG. 3A.
Figure 4A:
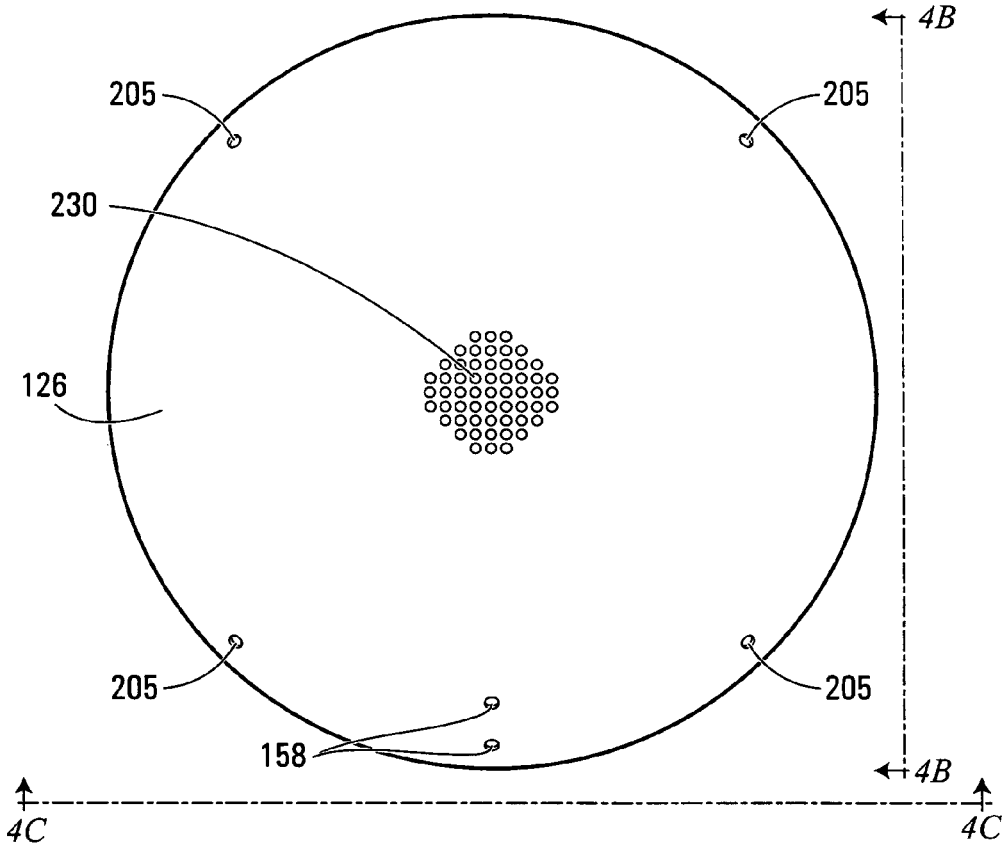
FIG. 4A is a front view of the outer filter of the front diffuser shield of FIG. 3A.
Figure 4B:
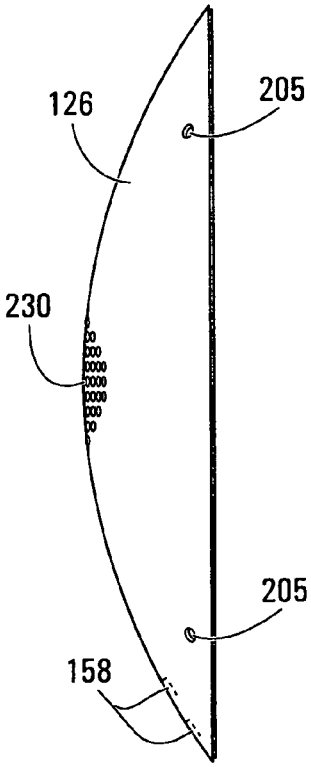
FIG. 4B is a side view of the outer filter of FIG. 4A taken along line 4B-4B.
Figure 4C:
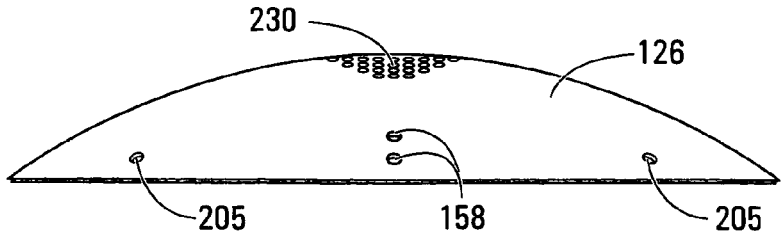
FIG. 4C is a bottom view of the outer filter of FIG. 4A taken along line 4C-4C.
Figure 4D:
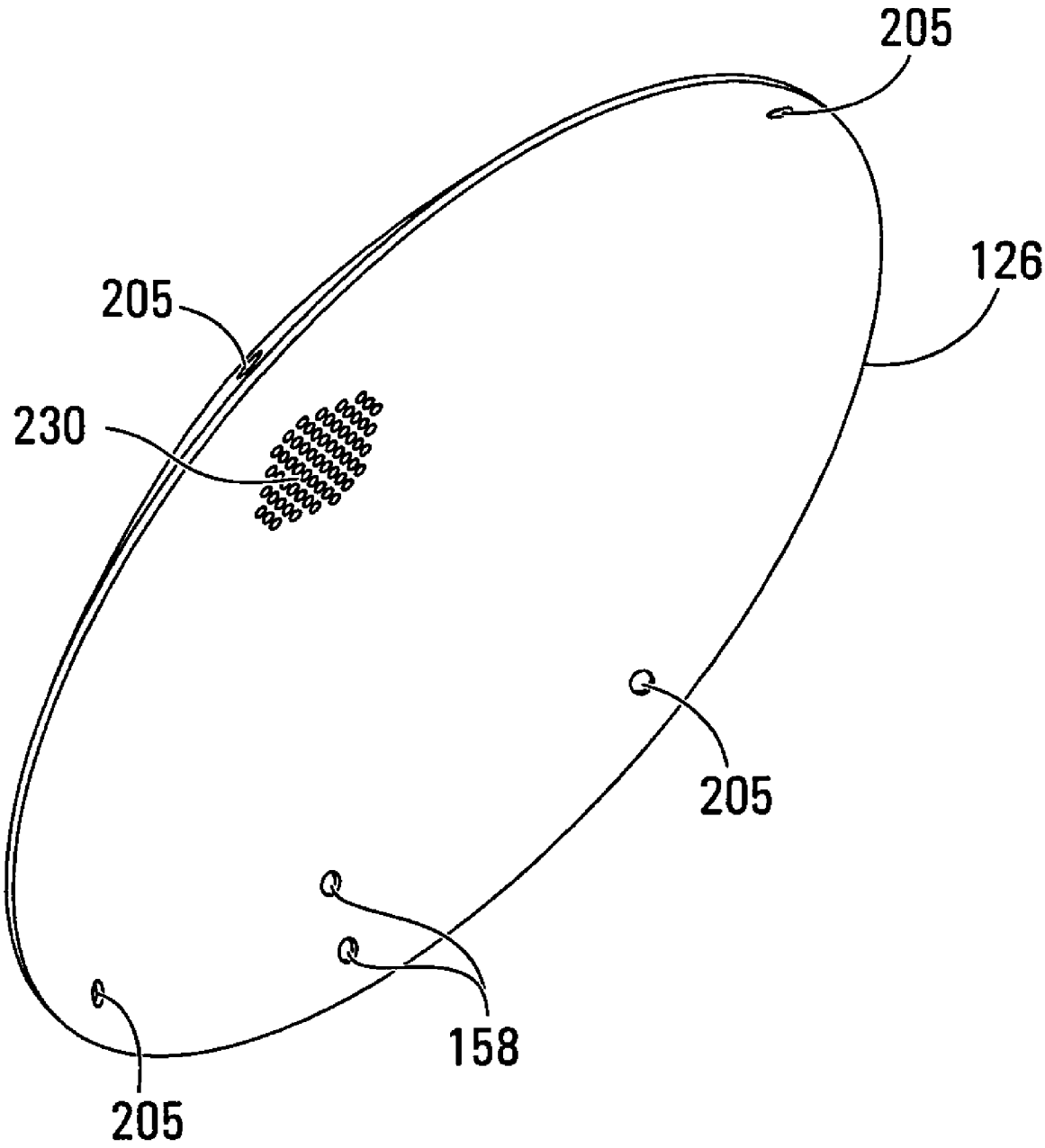
FIG. 4D is a rear perspective view of the outer filter of FIG. 4A.

With particular reference to FIG. 3B, in the embodiment depicted, the interior disk 127 is slightly larger in diameter than the diameter of the bulbous portion of the lamp 35. However, it should be noted that in other embodiments, where the shape, size and wattage of the lamp vary, the shape and size of the interior disk could also vary accordingly.

The outer filter 126 of the front diffuser shield 125 will now be described in further detail with reference to FIGS. 4A, 4B, 4C and 4D. It will be understood that the outer filter 136 of the rear diffuser shield 135 is configured in a similar manner. As discussed above, the outer filter 126 contains perforations 230. Although FIGS. 4A, 4B, 4C and 4D only depict a portion of the perforations 230 near the centre of the outer filter 126, it will be understood that the entire surface of the outer filter 126 of the illustrated embodiment contains perforations.

In the embodiments depicted, the outer filter 126 is constructed of aluminum with an approximate thickness of 1.02 mm. The outer filter 126 is approximately 165.1 mm in diameter with a curvature radius of approximately 140 mm and a depth of approximately 27.8 mm. The perforations 230 of the outer filter 126 in the embodiment depicted have a diameter of 1.59 mm. The centres of the perforations 230 are 2.78 mm apart and staggered. In the result, approximately 30% of the outer filter 126 is open. It will be understood that in other embodiments, the perforations could be any suitable shape or size. In addition, it will be understood that the shape and size of the outer filter 126 and the perforations 230 could vary without necessarily departing from the scope of the present invention.

The interior disk 127 of the front diffuser shield 125 will now be described in further detail with reference to FIGS. 5A, 5B, 5C and 5D. It will be understood that the interior disk 137 of the rear diffuser shield 135 is configured in a similar manner.

In the illustrated embodiment, the interior disk 127 is constructed of three laminated layers of glass, namely front and rear layers of transparent glass 131, 133, each approximately 3.3 mm in thickness, and an inner layer of white glass 132, approximately 1.2 mm in thickness. The interior disk 127 has a total thickness of approximately 7.8 mm, and is approximately 95 mm in diameter. However, it will be understood that the shape and size of the interior disk 127 could vary without necessarily departing from the scope of the present invention.

In the embodiment depicted, the interior disk 127 has a middle sandblasted region 128 on the rear outer surface of the rear transparent glass layer 133. The sandblasted region 128 is a central horizontal band, and is approximately 52 mm in height and approximately 80 mm in length at the top and bottom of the sandblasted region 128. In the present embodiment, the remaining portions of the rear outer surface of the rear transparent glass layer 133 are not sandblasted, and comprise clear regions 129 at the upper and lower polar regions of the surface. As discussed above, the interior disk 127 has upper and lower holding grooves 220, 225 for engaging the wire braces 210 that secure the interior disk 127 the outer filter 126 (not shown). The size of the holding grooves 220, 225 will depend on the gauge of the wire braces employed. Alternatively, in other embodiments, no holding grooves may be necessary.

The diffuser shield 125 is maintained in proximity with the lamp to enable the interior disk 127 and outer filter 126 to disperse light from the lamp onto the surface to be illuminated. In the illustrated embodiment, the light is dispersed by the sandblasted region 128 and layer of white glass 132 of the interior disk 127 and by the perforations 230 of the outer filter 126. It will be understood that in other embodiments, the interior disk and outer filter could disperse light from the lamp in any number of suitable ways, without necessarily departing from the scope of the present invention. For example, the interior disk could be sandblasted, frosted or otherwise coated, in a defined region or throughout the entirety of a surface, on one exterior surface of the interior disk or on another surface or surfaces. Similarly, the outer filter could be constructed of sandblasted or frosted glass, dimpled clear plastic, etc. The interior disk and outer filter could be constructed of any suitable material or combination of materials, including, glass, plastic, Plexiglas™, metal, etc. so long as the material or materials employed are able to withstand heat from the lamp, are of sufficient rigidity for proper support, and are able to perform the required dispersion function. The material or materials employed may be required to meet other requirements, depending on the particular application.

In addition, although the diffuser shield depicted and described above comprises two components, it will be understood that the diffuser shield could comprise only one component, or could comprise three or more components, so long as the diffuser shield is capable of performing the required dispersion function. Such a diffuser shield could be constructed of any appropriate material, including those discussed above.

In the embodiments depicted and described above, the invention is capable of uniformly illuminating two surfaces, located on front and rear sides of the lamp. In such case, the convex sides of the outer filters are each directed towards a surface. However, it will be understood that the present invention could also be used to illuminate only one surface. One or two diffuser shields could be employed in such an embodiment. Where one diffuser shield is used, the convex side of the outer filter of the diffuser shield is directed towards the surface to be illuminated. Where two diffuser shields are used, the convex side of the outer filter of the first diffuser shield is directed towards the surface, while the convex side of the outer filter of the second diffuser shield is directed away from the surface. In addition, it is possible to have an embodiment of the present invention that employs more than two diffuser shields with each lamp. Such an embodiment could be used to uniformly illuminate 1, 2, 3, or more surfaces, if desired.

In operation, as described above, the outer filter and interior disk of the illustrated embodiment disperse light from the lamp onto the projection side of the surface to be illuminated, which faces the lamp. The light from the lamp is dispersed to illuminate a lighting footprint region on the projection side, within which uniform illumination is achieved. In one possible embodiment, the surface is translucent, and thus able to refractively disperse light projected onto the surface. As a result, the light projected onto the projection side of the surface is further dispersed by the surface, and the lighting footprint region is uniformly illuminated when viewed from the opposite viewing side of the surface.

When a lighting footprint region is equal to or greater than the size of the surface to be illuminated, only one lighting system need be used. However, when the surface to be illuminated is larger in size than the lighting footprint region created by one lighting system, and where uniform illumination of the entire surface is desired, multiple lighting systems can be used. When appropriately placed so that there is a slight overlap of adjacent lighting footprint regions created by adjacent lighting systems, the lighting systems of the invention can be used to uniformly illuminate a surface of virtually any size and shape, with reduced brighter or dimmer areas of illumination throughout the entirety of the surface.

Figure 6:
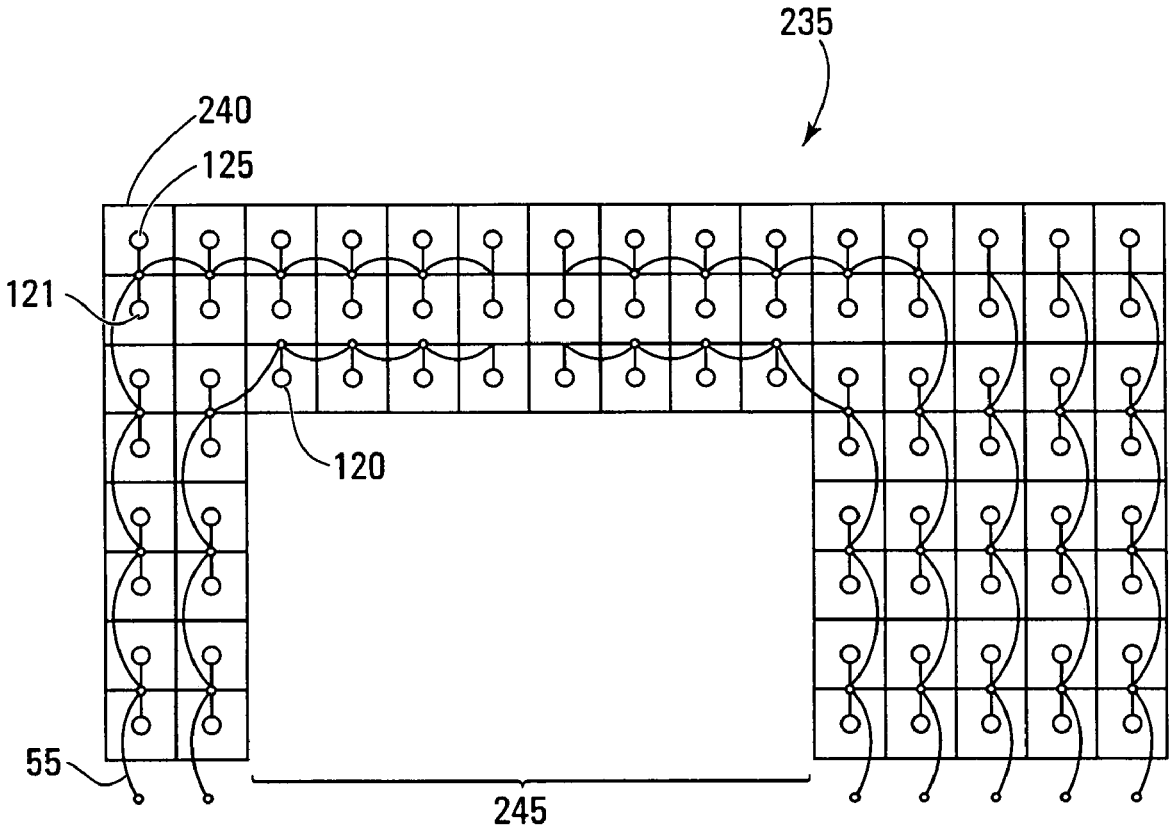
FIG. 6 is a schematic diagram showing a possible configuration of the embodiments depicted in FIGS. 1 and 2 to produce a uniformly lit surface.

FIG. 6 depicts one configuration of a translucent front surface 235 that can be uniformly illuminated using the lighting systems described above. The front surface 235 depicted in FIG. 6 is approximately 32'×60' in total area, and is divided into 4'×4' individual panels 240. A translucent rear surface (not shown) of similar size and construction is located behind the front surface 235. Between the front and rear surfaces are a number of the lighting systems depicted and described above, supported by any acceptable means known in the art. The front diffuser shields 120, 121, 125 of the lighting systems face the front surface 235 and are located approximately in the centre of each individual panel 240. The rear diffuser shields 130, 131, 135 (not shown) of the lighting systems face the rear surface (not shown) in a similar manner. In the embodiment depicted in FIG. 6, there is a large open section 245 in the front and rear surfaces. Such a section could be used to incorporate a portal, doorway or other opening. Alternatively, the surfaces could contain no such opening.

In operation, in the embodiment depicted in FIG. 6, light from the lamps of the lighting systems is dispersed by the front diffuser shields 120, 121, 125 onto lighting footprint regions on the projection side of the front surface 235. In addition, some of the light from the lamps is reflected by the rear diffuser shields (not shown) and the rear surface (not shown) onto the projection side of the front surface 235. The projection side of the rear surface is illuminated in a analogous manner. The light dispersed and reflected onto the projection sides of the front and rear surfaces is refractively dispersed by the surfaces. In the result, the front and rear surfaces are uniformly illuminated throughout their entirety when viewed from the opposite viewing sides of the surfaces, with appropriate adjustments to the location of the lamps in relation to one another and in relation to the front and rear surfaces as may be necessary.

In the embodiment shown in FIG. 6, the individual panels 240 of the front surface 235 are constructed of glass. However, it will be understood that any other suitable material could also be used, such as plastic, Plexiglas, etc. If required, the individual panels 240 can be secured to one another by any appropriate connection means known in the art (not shown). It should also be noted that rather than being made up of individual panels 240, the front surface 235 could be one uniform piece of glass or other appropriate material. The individual panels 240 of the front surface 235 can be supported by any appropriate structural system known in the art (not shown). Alternatively, the structural system used to support the components of the lighting systems could also be used to support the individual panels 240 of the front surface 235. Any potential problems with shadowing caused on the front surface 235 by either the connection means or the structural system can be overcome by appropriate adjustments to the placing of the lamps of the lighting systems, adjustments to the components of the connection means or structural system, and/or by the placing of baffles for reflecting light from the lamps where required. Similar comments apply to the rear surface (not shown).

It will be understood that the embodiments depicted and described in relation to FIGS. 1-6 above relate to only a limited number of the possible embodiments of the present invention. As discussed above, variations of a number of elements of the present invention are possible without departing from the scope of the invention. For example, it will be generally understood that the shape, size and wattage of the lamps employed can vary. This may require corresponding adjustments to the configuration, shape, size, and positioning of the components of the diffuser shields, and corresponding adjustments to the positioning of the lamp (or lamps) of the lighting system (or lighting systems) in relation to other lamps, if present, and in relation to the surface or surfaces to be illuminated. In addition, although the light source employed with the embodiment of the present invention described above is a lamp, it will be understood that the present invention could be used in association with any light source, including the sun, candles, etc. All such variations are intended to be covered within the scope of the present invention.

In addition, it will also be generally understood that the size, shape and structure of the surface to be illuminated may vary considerably and the size and shape of the individual panels (if present) may also vary considerably. Such variations may again require corresponding variations to the lamps, components of diffuser shields and the positioning and number of lamps employed. Again, such variations are intended to be covered within the scope of the present invention.

Further, although an induction lighting unit is employed in the embodiments depicted and described above, it will be understood that other types of lighting units could be used, including HID, incandescent, fluorescent and LED units, with appropriate adjustments and modifications where necessary.

Finally, it will be understood that the applications of the present invention are not limited to the illumination of the viewing side of a translucent surface. For example, the lighting system could also be used for uniform illumination of the projection side of an opaque surface. One or more lighting systems could be used to illuminate one or more such surfaces, with appropriate adjustments as may be required, including adjustments to the overlap of the lighting footprint regions where multiple lighting systems are employed. The present invention could be used in such an embodiment for the uniform illumination of artwork, signs, billboards, etc., or in applications relating to indoor or outdoor lighting in general. In addition, the present invention could be used in relation to the uniform illumination of other surfaces, and/or objects, with appropriate adjustments as described above. Such embodiments could, for example, be used as lamps, or flashlights, or in any lighting application that would require or benefit from uniform illumination.

While specific embodiments have been shown and described, it will generally be known and understood that many variations are possible. The invention may be embodied in other specific forms without departing from the spirit or purpose thereof. The present embodiments are therefore to be considered as illustrative and not restrictive, the scope of the invention being indicated by the appended claims and their equivalents rather then by the foregoing description, and all changes that come within the equivalency of the claims are therefore intended to be embraced therein.

The invention claimed is:

1. A diffuser shield, in combination with a light source, back illuminating a translucent panel, such diffuser shield comprising:

an opaque outer filter shield having a concave surface directed toward said light source, and a plurality of perforations uniformly distributed to permit light transmission through the filter shield; and an interior disk having a central translucent band, and upper and lower translucent regions of greater translucency than the central translucent band, at opposite sides of the central translucent band;

wherein said diffuser shield is maintained in proximity with said light source to disperse said light from said light source and uniformly illuminate the translucent panel.

2. The diffuser shield of claim 1 further comprising said translucent panel.

3. The diffuser shield of claim 1 wherein said outer filter shield is about 30% open.

4. The diffuser shield of claim 1 wherein said central translucent band is a sandblasted region.

5. The diffuser shield of claim 4 wherein the sandblasted region is positioned on the surface of said interior disk.

6. The diffuser shield of claim 5 wherein said surface faces said light source.

7. The diffuser shield of claim 1 wherein said central translucent band comprises two outer layers of transparent glass and an inner layer of white glass.

8. The diffuser shield of claim 7 wherein said central translucent band is a sandblasted region.

9. The diffuser shield of claim 8 wherein said sandblasted region is on an outer surface of said transparent glass.

10. The diffuser shield of claim 9 wherein said outer surface faces said light source.

11. An apparatus for uniform illumination comprising:

a light source; and a diffuser shield according to claim 1.

12. The apparatus of claim 11 comprising a plurality of light sources and a plurality of diffuser shields.

13. The apparatus of claim 12 wherein there are two diffuser shields associated with each light source.

14. The apparatus of claim 11 further comprising a transparent panel.

15. The apparatus of claim 14 wherein said apparatus comprises front and rear translucent panels, and front and rear diffuser shields disposed between said light source and said front and rear transparent panels, respectively.

16. The apparatus of claim 15 wherein a support is associated with said front and rear diffuser shields.

17. The apparatus of claim 11 wherein said light source is an induction lighting unit.

18. The apparatus of claim 17 wherein said induction lighting unit comprises a high frequency (HF) generator, a lamp and a coaxial cable connecting said generator to said lamp, and wherein said HF generator and said lamp are associated with a support structure.

19. The apparatus of claim 18 wherein said support structure comprises a horizontally directed and a vertically directed support.

20. The apparatus of claim 16 wherein said support is secured to the outer filter shield of said front diffuser shield and the outer filter shield of said rear diffuser shield.

21. The apparatus of claim 18 wherein a heat sink is associated with said support structure for dissipating heat from said light source.

* * * * *